US008220793B2

(12) United States Patent
Mezger

(10) Patent No.: US 8,220,793 B2
(45) Date of Patent: Jul. 17, 2012

(54) APPARATUS FOR THE THREAD-STITCHING OF FOLDED PRINT PRODUCTS

(75) Inventor: Franz Konrad Mezger, Lauda-Koenigshofen (DE)

(73) Assignee: Mueller Martini Holding AG, Hergiswil (CH)

( * ) Notice: Subject to any disclaimer, the term of this patent is extended or adjusted under 35 U.S.C. 154(b) by 173 days.

(21) Appl. No.: 12/613,820

(22) Filed: Nov. 6, 2009

(65) Prior Publication Data

US 2010/0117286 A1 May 13, 2010

(30) Foreign Application Priority Data

Nov. 10, 2008 (EP) ..... 08405277

(51) Int. Cl.
*B65H 37/04* (2006.01)

(52) U.S. Cl. ... 270/52.3; 270/37; 270/52.18; 270/52.23; 270/52.24; 270/52.26; 270/52.27; 270/58.08

(58) Field of Classification Search ..... 270/37, 270/52.14, 52.18, 52.23, 52.24, 52.25, 52.26, 270/52.27, 52.28, 52.3, 58.08; 412/6, 33, 412/35

See application file for complete search history.

(56) References Cited

U.S. PATENT DOCUMENTS

| | | | | |
|---|---|---|---|---|
| 4,041,883 | A * | 8/1977 | Meratti | 112/21 |
| 5,087,163 | A * | 2/1992 | Erdbories et al. | 412/35 |
| 5,248,234 | A * | 9/1993 | Hollenstein | 412/1 |
| 5,887,532 | A * | 3/1999 | Hollenstein et al. | 112/21 |
| 5,887,863 | A * | 3/1999 | Hollenstein et al. | 270/52.18 |
| 6,095,740 | A * | 8/2000 | Hollenstein et al. | 412/4 |
| 2006/0231998 | A1* | 10/2006 | Maeder | 270/52.14 |

FOREIGN PATENT DOCUMENTS

| | | | |
|---|---|---|---|
| EP | 0665121 | A1 | 8/1995 |
| EP | 0893275 | A1 | 1/1999 |
| EP | 1013470 | A1 | 6/2000 |
| EP | 1738922 | A2 | 1/2007 |
| FR | 2317104 | A1 | 2/1977 |
| GB | 637102 | A | 5/1950 |
| GB | 1425974 | A | 2/1976 |

OTHER PUBLICATIONS

European Search Report From EP 08405277.8 Filed Apr. 20, 2009 With English Translation.

* cited by examiner

*Primary Examiner* — Leslie A Nicholson, III

(74) *Attorney, Agent, or Firm* — Venable LLP; Robert Kinberg; Christopher Ma

(57) ABSTRACT

An apparatus for thread-stitching of folded print products includes a sewing station in which individual print products are stitched along the fold and print products are then sewn together along the spine to form a book block. A pivoting saddle supplies individual print products straddling thereon to the sewing station. A feeder separates folded print products from a stack of folded print products. A feeding arrangement includes a feed path connecting the feeder to the pivoting saddle, and has a feeding end that cooperates with the feeder to supply the individual print products to the feed path and a discharge end that operates to supply the individual print products to the pivoting saddle. The sewing station, as seen from the top, is arranged on the machine frame of the apparatus, between the feeding end of the feeding arrangement and the pivoting saddle.

17 Claims, 5 Drawing Sheets

APPARATUS FOR THE THREAD-STITCHING OF FOLDED PRINT PRODUCTS

CROSS-REFERENCE TO RELATED APPLICATION

This application claims the priority of European Patent Application No. 08405277.8, filed on Nov. 10, 2008, the subject matter of which is incorporated herein by reference in its entirety.

BACKGROUND OF THE INVENTION

The invention relates to an apparatus for the thread-stitching of folded print products, such an apparatus including a sewing station in which the individual print products are stitched along their fold and are then sewn together in the spine region that contains the fold, so as to form a book block. The apparatus includes a pivoting saddle for conveying the individual print products, positioned straddling thereon, to the sewing station, as well as a feeding arrangement having a feed end that cooperates with a feeder for supplying the individual print products and a discharge end which operates jointly with the pivoting saddle and supplies the individual print products to the pivoting saddle.

An apparatus of this type is known from Great Britain patent document GB 1425974, wherein the print products can be pulled with the aid of a gripper from the underside of a stack and can then be supplied to the carriers of a conveyor belt that circulates in a slanted upward direction. To pull them from the stack, the print products are gripped along the folding edge and are deposited on the conveyor belt, such that the folding edge of the print product is at the trailing end. An opening device is arranged along the conveyor belt which functions to successively open up the print products along the forward-facing, unbound edge and to transfer the product in the opened state to a rotating gripper drum. The gripper drum grips the individual print products along an overhanging edge of a print product leg that fits against the gripper drum. This is intended to open up the print product even further and allow the product to drop onto an underneath-arranged saddle once the gripper drum reaches a specific location. The saddle, which is designed to pivot and is controlled by an endless cam curve, functions to transfer the print product to the sewing station where the print product is sewn together with the previously conveyed print product while positioned on the saddle. A book block is formed by correspondingly stitching together a number of individual print products.

As a result of its mode of operation and the required configuration, this apparatus requires a considerable amount of space and does not provide easy access for operating personnel.

The thread-stitching machines disclosed in European patent documents EP 665121 A1, EP 893275 A1 and EP 1013470 A1 also require a lot of space. In addition, the feeding distance for these machines is relatively long, which reduces the overview and control over the processing of the print products.

SUMMARY OF THE INVENTION

It is therefore an object of the invention to provide an apparatus having a compact design, in particular one with shorter processing distances, wherein this apparatus should be easier to control and operate.

The above and other objects are achieved according to the invention wherein there is provided, in one embodiment, an apparatus for thread-stitching of folded print products each having a spine including at least one fold, the apparatus comprising: a machine frame; a sewing station on which print products are stitched along the fold and are then sewn together along the spine to form a book block; a pivoting saddle to supply individual print products positioned straddling thereon to the sewing station; a feeder to separate folded print products from a stack of folded print products; and a feeding arrangement including a feed path connecting the feeder to the pivoting saddle, and having a feeding end that cooperates with the feeder to supply the individual print products to the feed path and a discharge end that operates to supply the individual print products to the pivoting saddle; wherein the sewing station, as seen from the top, is arranged on the machine frame of the apparatus, between the feeding end of the feeding arrangement and the pivoting saddle.

The invention thus takes a surprising direction that results in achieving optimum accessibility and furthermore makes it possible to omit an auxiliary saddle that is needed in addition to the stitching saddle (see also EP 665121 A1).

According to one embodiment, the feeding arrangement includes an underneath-arranged conveying path that connects the feeder to the saddle, to create shorter conveying paths and improve the accessibility.

In another embodiment, a clearance space may be arranged underneath the sewing station to accommodate, at least in part, the underneath arranged conveying path.

Alternatively, the feeding arrangement may be embodied as an above-arranged conveying path that connects the feeder and the saddle, so that oversight, operation and control can be optimized.

A clearance space above the sewing station that cannot be obstructed is therefore used to accommodate the conveying path at least in part.

The print products may be conveyed fold forward along the conveying path, which allows an easy handling of the print products along the conveying path.

However, the apparatus according to the invention is suitable to convey the print products either fold forward or with the fold trailing.

A transfer device may be assigned to the saddle to ensure a careful and uninterrupted transfer of the print products to the saddle.

According to a further embodiment of the apparatus, an opening device may be advantageously arranged along the conveying path, either in front of or above the saddle, wherein this device may be used to open up the print products along the non-closed edge and to subsequently transfer the products to the saddle, such that they are positioned straddling thereon. The saddle may be furthermore arranged on the machine frame so that it can pivot around a locally fixed axis of rotation.

The sewing station may be provided with a plurality of uniformly spaced apart and side-by-side arranged punching needles for respectively punching through the fold from an inside of the print products, as well as with stitching and hook needles that punch through the fold from an outside of the print products, and a thread pulling device that transports the thread from a stitching needle to a hook needle. The sewing station and the feeding arrangement for the print products are arranged opposite each other. A book block delivery station may be arranged downstream of the sewing station.

BRIEF DESCRIPTION OF THE DRAWINGS

The invention is explained in further detail in the following with the aid of various embodiments and with reference to the cited prior art as well as the drawing, to which reference is made for all details not described further herein.

DETAILED DESCRIPTION

Figure 1:
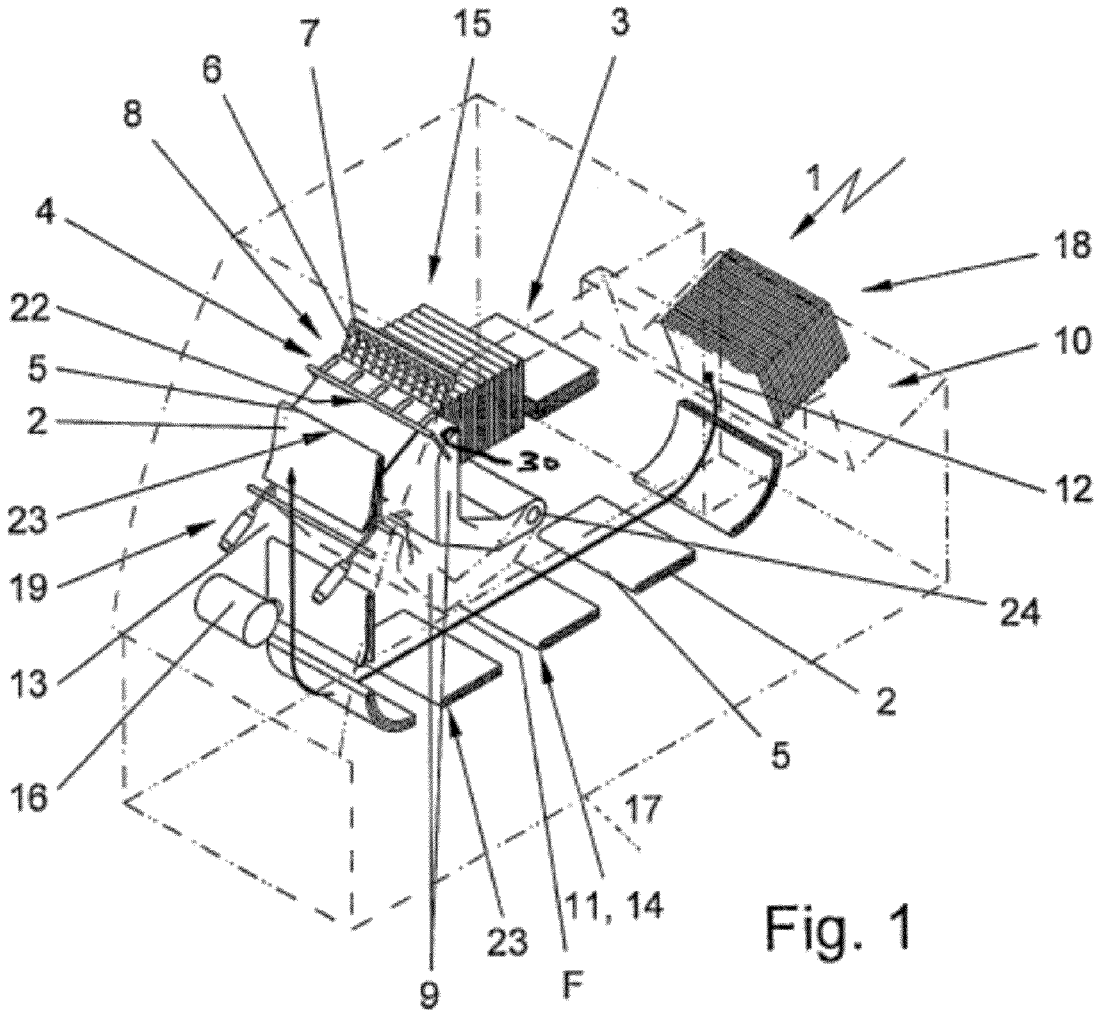
FIG. 1 is a schematic, three-dimensional representation of an apparatus according to the invention with an underneath-arranged conveying path and print products deposited thereon, respectively with the fold forward.

FIG. 1 illustrates an apparatus 1 for the thread-stitching of folded print products 2. The apparatus 1 essentially comprises a sewing station 4 with a plurality of spaced-apart and side-by-side arranged punching needles 25 (FIG. 3) that punch from the inside through the fold 5 of the print products 2. The apparatus further comprises stitching and hook needles 6, 7 that punch from the outside through the fold 5, as well as a mechanical or pneumatic-mechanical thread-pulling device 8. Individual print products 2 are initially stitched in the sewing station 4 along the fold 5 and are subsequently sewn together along the spine 23 that contains the fold 5 while fitting flat against each other, so as to form a book block 3. The print products 2 are supplied to the sewing station 4 while positioned on a pivoting saddle 9. The saddle 9 can be pivoted around a locally fixed axis of rotation 24, arranged on a machine frame 17 of the apparatus 1, wherein the saddle is supplied with respectively one print product 2 in the starting or feeding position that is shown with dash-dot line herein. The print product is opened up on the non-closed side with an opening device 16 and is then deposited straddling on a ridge 30 of the saddle 9.

For this, the print products 2 may be separated from a stack formation 18 with the aid of a feeder 10 and are deposited on the conveying path 11 of a conveying device that is on the whole referred to as a feeding arrangement 14, which is operatively connected via a feed end 12 to the feeder 10 and via a discharge end 13 to the saddle 9. Downstream of the sewing station 4 is a book block delivery station 15 in which the stitched-together book blocks 3 are laid out for the further processing stations.

Figure 3:
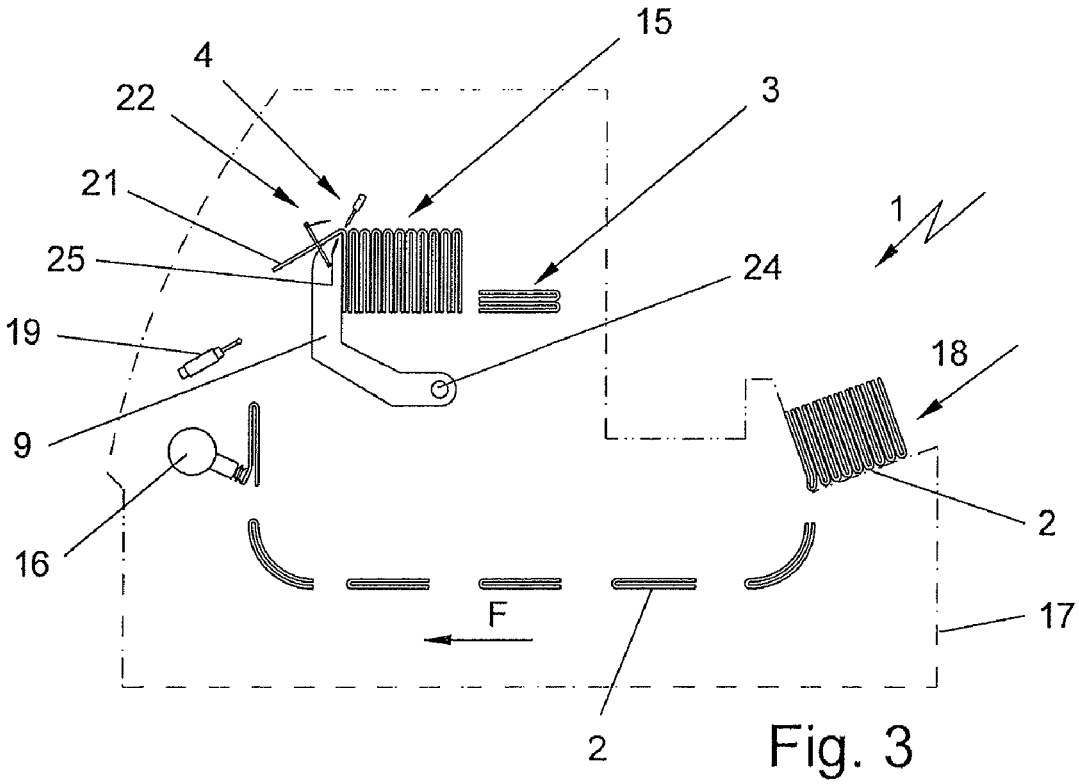
FIG. 3 is a longitudinal section according to FIG. 2, showing the saddle in the position where the print products are stitched.
Figure 2:
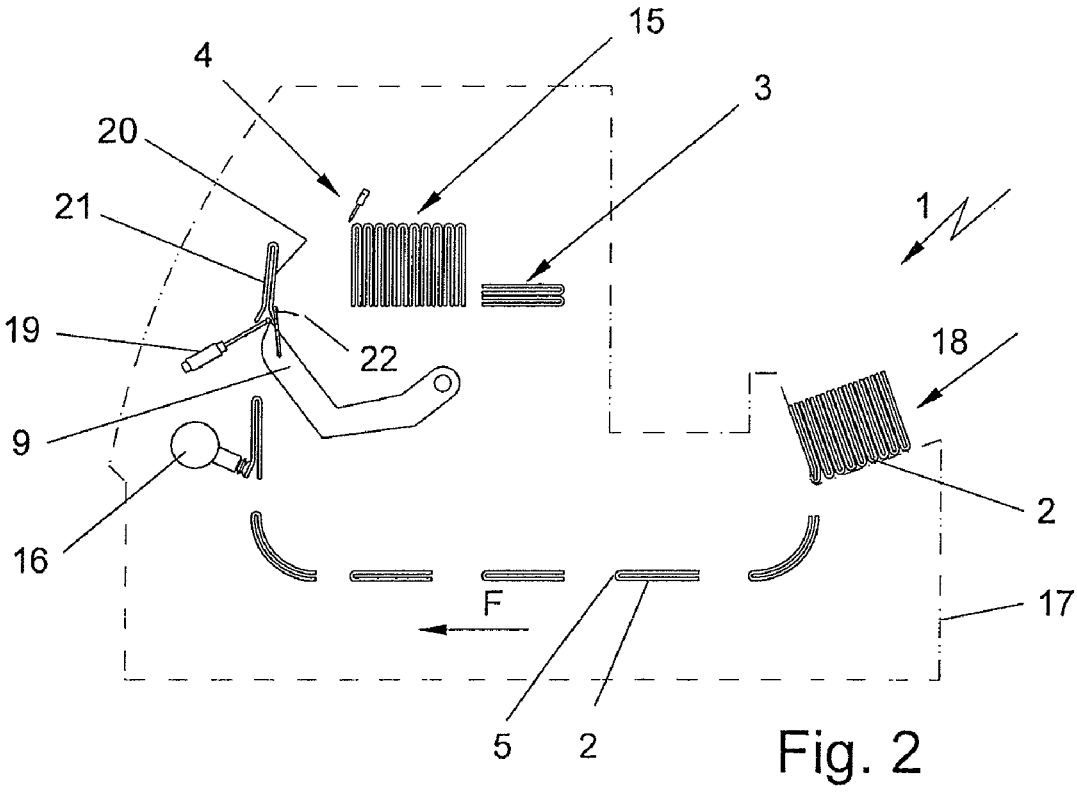
FIG. 2 is a longitudinal section through the apparatus shown in FIG. 1, as seen along the conveying path for the print products and in the position where the products are supplied to the saddle.

After leaving the feeder 10, the print products 2 are conveyed along the conveying path 11, which is arranged at least in part below the sewing station 4, and are supplied in a clocked operation to the saddle 9 that operates synchronously with the sewing station 4. The apparatus 1 consists of a machine frame 17 to which the above-described units or components are attached. The print products 2 are conveyed individually or in the form of an overlapping flow. FIGS. 1 and 2 show among other things the position in which the saddle 9 is supplied, as well as the opening device 16 and the conveying direction that is marked with an arrow F, wherein for the processing shown in FIGS. 1 to 3, the print products 2 are conveyed with the spine 23, respectively the fold 5, facing forward and such that they extend with the flat side transverse to the conveying direction F. The products can be conveyed, for example, with the aid of clamps (not shown herein) attached to a circulating traction means which clamp in the print products 2 along the fold 5 and convey them to a position above the saddle 9. In FIG. 2, the saddle is shown in the position where it is supplied. The opened print product 2 reaches with its trailing end at least at the level of the saddle peak. As shown in the example, the open print product is moved with the aid of a push rod 19 with its back leg 20, positioned at a distance to the front leg 21, to a supply position where it can subsequently be released from the clamps and can be dropped onto the saddle 9. Immediately after the clamp releases a print product 2, the push rod 19 is moved back, as shown in FIG. 3, and the saddle 9 with thereon positioned print products 2 moves into to the sewing station 4. In this position, each print product 2 is stitched and several print products 2 are then sewn together to form a book block 3. The operational steps for stitching the individual products or stitching together multiple print products 2 are discussed among other things in the aforementioned European prior art documents.

A scraper device 22 in shown in FIG. 3 in an operating position ensures that the free-standing, front leg 21 of the print product 2 fits against the saddle 9 during the individual stitching operations and the stitching together of the print products. In contrast, the scraper device 22 is in the rest position away from the saddle (see FIG. 2) when the print products are supplied to the saddle 9. The apparatus 1 clearly shows the underneath-arranged conveying path 11, which extends below the sewing station 4 and connects the feeder 10 and the saddle 9 as a result of the positioning of the feeding arrangement 14. For this embodiment, the print product 2 is pulled from a stack of upright products resting on the folds 5. The product is then briefly conveyed while positioned horizontally, and is subsequently transported in upward direction where it is deposited on the saddle 9 (FIGS. 1 and 2). The mechanism used for this operation is sufficiently well known.

Figure 5:
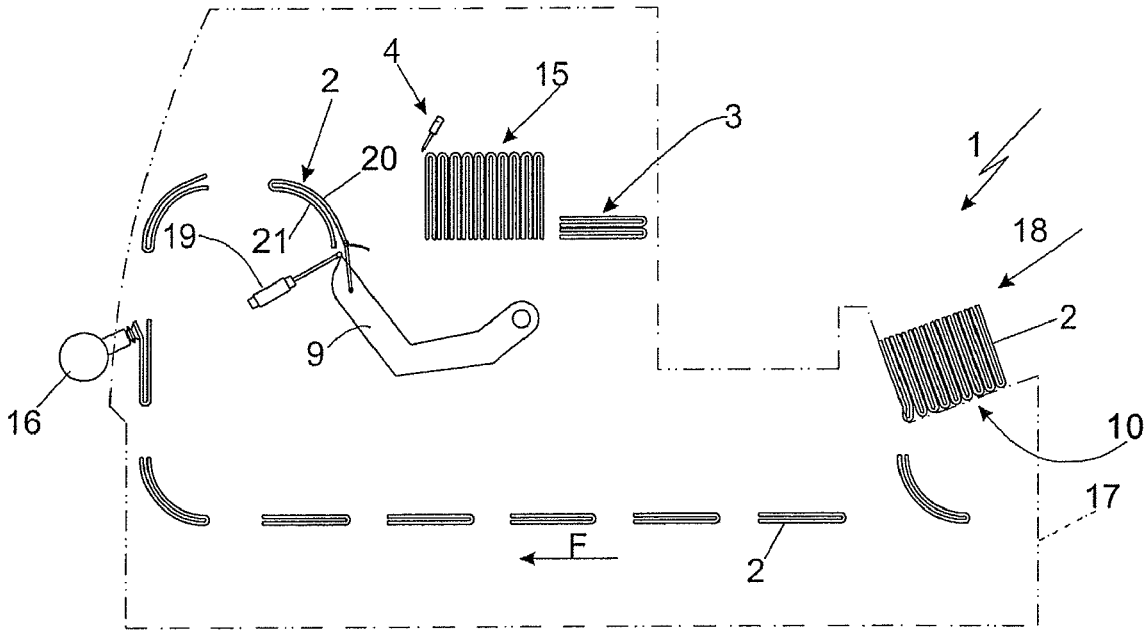
FIG. 5 is a longitudinal section through the apparatus shown in FIG. 4, as seen along the conveying path for the print products and showing the saddle in the position where it is supplied.
Figure 4:
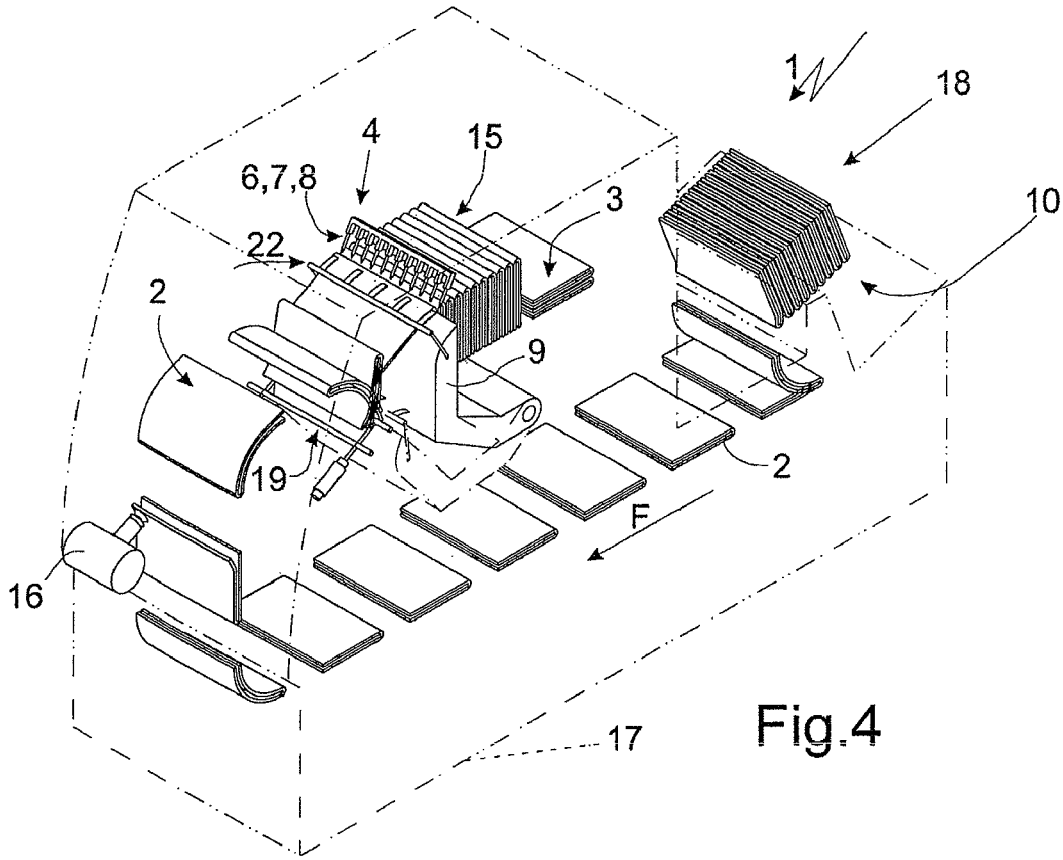
FIG. 4 is a schematic and three-dimensional representation of an apparatus according to the invention, with underneath-arranged conveying path on which the print products are respectively conveyed with the folding edge in the rear.

FIGS. 4 and 5 show an apparatus 1 for the thread-stitching of folded print products 2, comprising a conveying path 11 that is alternatively arranged underneath, on which the print products 2 are stacked while standing upright and are then turned after leaving the feeder 10 before being moved along the conveying path 11 with the open side forward. An opening device 16 is again arranged along the conveying path 11, upstream of the saddle 9, wherein this opening device opens up each print product 2 along the non-closed, forward-facing edge and then transfers the print product to the available saddle 9. To support the transfer operation, this embodiment also includes a push rod 19 which deflects one of the two legs 20, 21 to ensure a non-frictional transfer.

Figure 7:
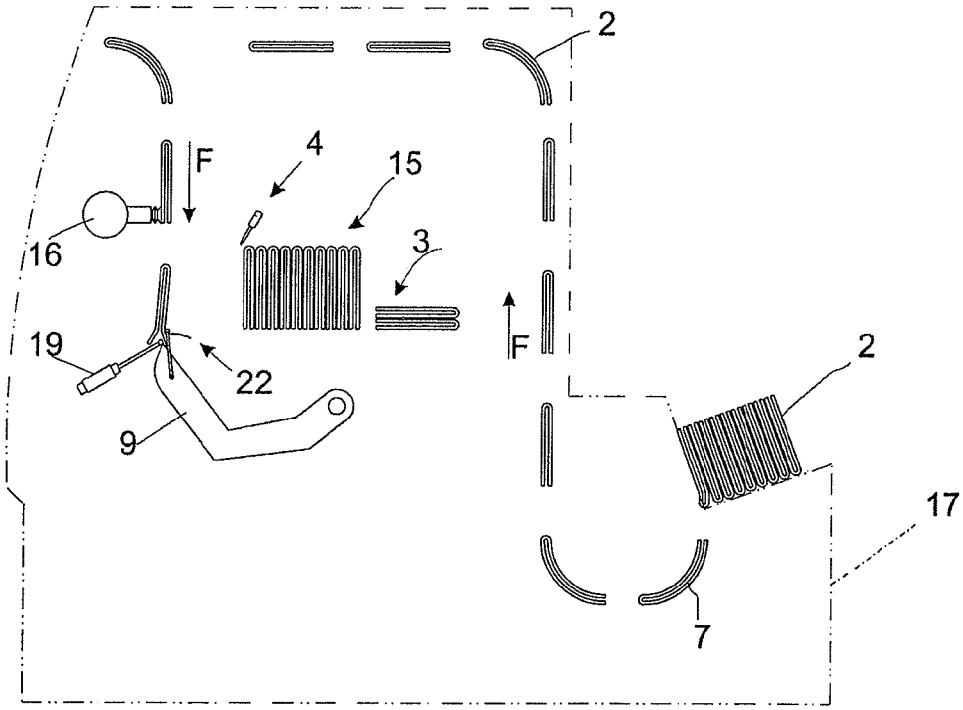
FIG. 7 is a longitudinal section through the apparatus shown in FIG. 6, along the conveying path for the print products and showing the position where the saddle is supplied.
Figure 6:
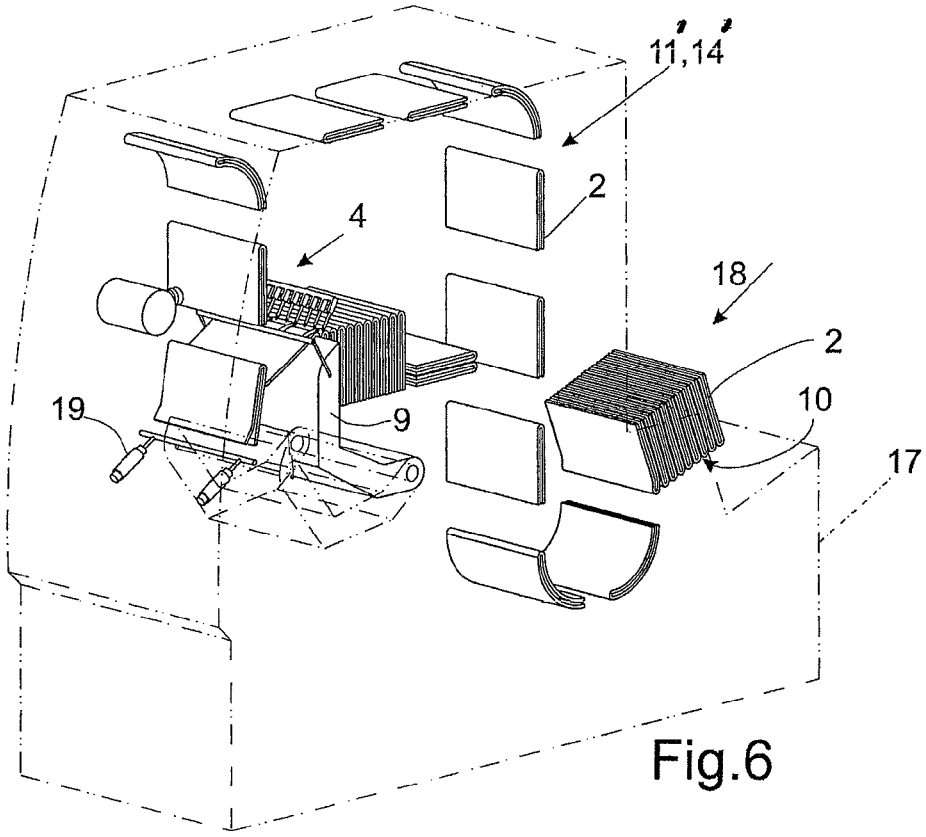
FIG. 6 is a schematic, three-dimensional representation of an apparatus according to the invention, with above-arranged conveying path.

According to an alternative embodiment, the feeding arrangement 14' can also have an above-arranged conveying path 11', for example as shown in FIGS. 6 and 7 as well as 8 and 9.

According to FIGS. 6 and 7, the print product 2 is pulled fold-forward from the stack, in the same way as for the embodiment shown in FIGS. 1 to 3, is then deflected and moved upward between the feeder 10 and the sewing station 4, is conveyed further past the sewing station 4 and is turned, so that the opened side of the print product 2 now faces the available saddle 9. The last section of the conveying path 11' for the feeding arrangement 14' extends approximately perpendicular to the saddle 9, to which an opening device 16 and a push rod 19 are assigned. This embodiment also meets the requirements according to the invention.

Figure 9:
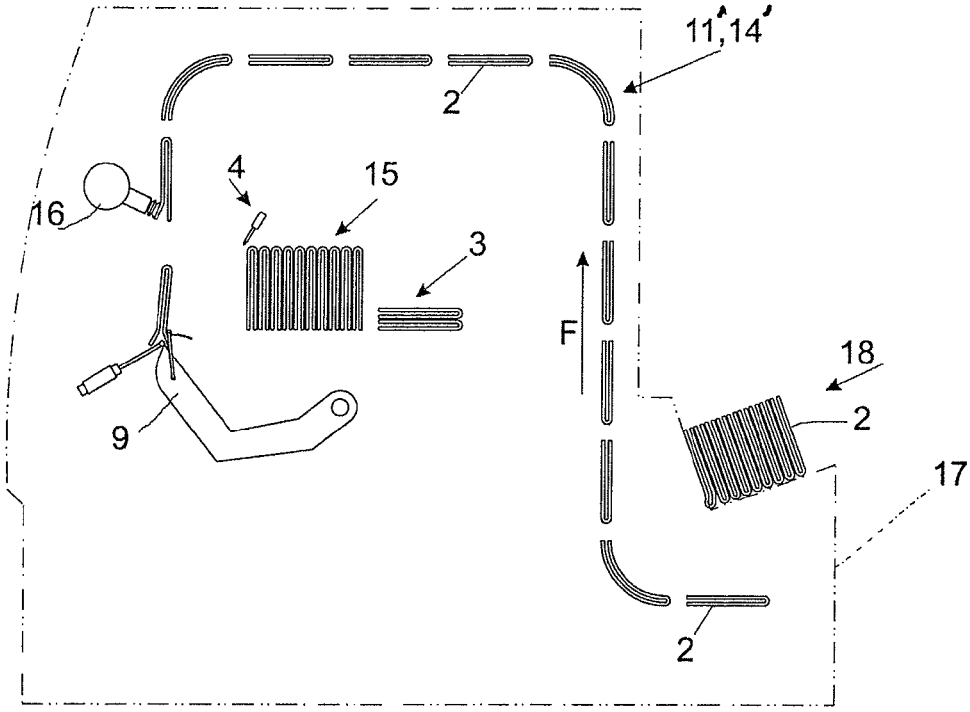
FIG. 9 is a longitudinal section through the apparatus shown in FIG. 8, as seen along the conveying path for the print products.
Figure 8:
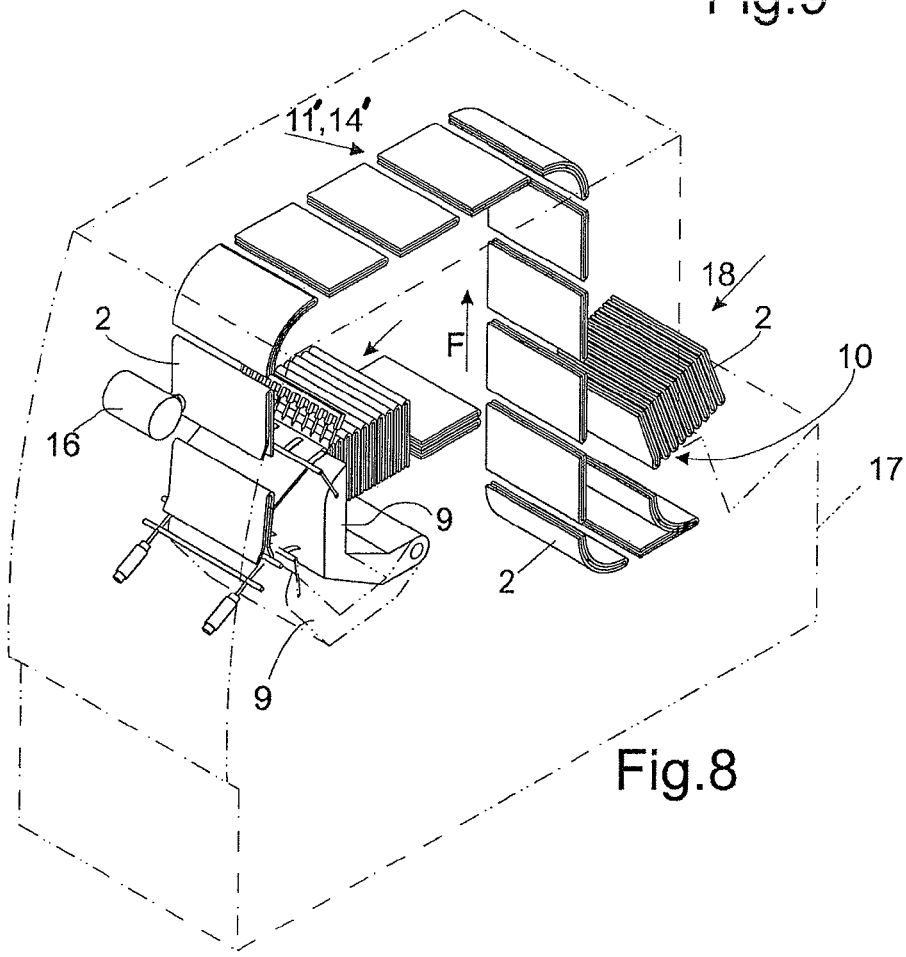
FIG. 8 is a schematic, three-dimensional representation of an apparatus according to the invention, with above-arranged conveying path on which the print products are respectively conveyed with the fold trailing.

As an alternative to the embodiment shown in FIGS. 6 and 7, the embodiment illustrated in FIGS. 8 and 9 differs in that the print products 2 are conveyed with the fold 5 trailing, meaning with the open edge facing forward. FIG. 8 shows that the print product 2 is initially pulled off in downward direction from the formed stack 18 and is then deflected in such a way that the open edge points in conveying direction F. Following this, the print product 2 is moved in upward direction between the feeder 10 and a back side of the sewing station 4 and is then conveyed further along an above-arranged path before being supplied in approximately vertical direction to the available saddle 9. On this last section of the conveying path 11', the print product 2 is opened on one side and is subsequently released by the circulating clamp, so that it can be pushed by the push rod 19 to drop onto the saddle 9.

It will be understood that the above description of the present invention is susceptible to various modifications, changes and adaptations, and the same are intended to be comprehended within the meaning and range of equivalents of the appended claims.

What is claimed is:

1. An apparatus for thread-stitching of folded print products each having a spine including at least one fold, the apparatus comprising:

a machine frame;

a sewing station on which print products are stitched along the fold and are then sewn together along the spine to form a book block;

a pivoting saddle having a ridge to supply individual print products positioned straddling the ridge thereon to the sewing station;

a feeder to separate folded print products from a stack of folded print products; and a feeding arrangement including an underneath-arranged feed path extending underneath the sewing station connecting the feeder to the pivoting saddle, and having a feeding end that cooperates with the feeder to supply the individual print products to the feed path and a discharge end that operates to supply the individual print products to the pivoting saddle;

wherein the sewing station, as seen from above the machine frame, is arranged on the machine frame of the apparatus, to remain between the feeding end of the feeding arrangement and the ridge of the pivoting saddle.

2. The apparatus according to claim 1, wherein the conveying path is arranged at least in part below the sewing station.

3. The apparatus according to claim 1, wherein the sewing station comprises:

a plurality of spaced apart and side-by-side arranged punching needles that punch through the fold from an inside of the fold of the print product;

stitching and hook needles that punch through the fold from an outside of the fold of the print product; and a thread-pulling device which transports the thread from the stitching needle to the hook needle.

4. The apparatus according to claim 1, wherein the sewing station and the feeding arrangement are positioned opposite each other.

5. The apparatus according to claim 1, further comprising a book block delivery station arranged downstream of the sewing station.

6. The apparatus according to claim 1, wherein the saddle is arranged on the machine frame so that the saddle is pivotable around a locally fixed axis of rotation.

7. The apparatus according to claim 1, wherein the feeding arrangement is adapted to convey the print products either with the fold forward or trailing.

8. The apparatus according to claim 1, further comprising an opening device to open up the print products arranged in a conveying direction along the conveying path at least one of upstream of the saddle or above the saddle.

9. An apparatus for thread-stitching of folded print products each having a spine including at least one fold, the apparatus comprising:

a machine frame;

a sewing station on which print products are stitched along the fold and are then sewn together along the spine to form a book block;

a pivoting saddle having a ridge to supply individual print products positioned straddling the ridge thereon to the sewing station;

a feeder to separate folded print products from a stack of folded print products; and a feeding arrangement including an above-arranged feed path extending above the sewing station connecting the feeder to the pivoting saddle, and having a feeding end that cooperates with the feeder to supply the individual print products to the feed path and a discharge end that operates to supply the individual print products to the pivoting saddle;

wherein the sewing station, as seen from above the machine frame, is arranged on the machine frame of the apparatus, to remain between the feeding end of the feeding arrangement and the ridge of the pivoting saddle.

10. The apparatus according to claim 9, wherein the conveying path is arranged at least in part above the sewing station.

11. The apparatus according to claim 9, further comprising an opening device to open up the print products arranged in a conveying direction along the conveying path at least one of upstream of the saddle or above the saddle.

12. The apparatus according to claim 9, wherein the sewing station comprises:

a plurality of spaced apart and side-by-side arranged punching needles that punch through the fold from an inside of the fold of the print product;

stitching and hook needles that punch through the fold from an outside of the fold of the print product; and a thread-pulling device which transports the thread from the stitching needle to the hook needle.

13. The apparatus according to claim 9, wherein the sewing station and the feeding arrangement are positioned opposite each other.

14. The apparatus according to claim 9, further comprising a book block delivery station arranged downstream of the sewing station.

15. The apparatus according to claim 9, wherein the saddle is arranged on the machine frame so that the saddle is pivotable around a locally fixed axis of rotation.

16. The apparatus according to claim 9, wherein the feeding arrangement is adapted to convey the print products either with the fold forward or trailing.

17. An apparatus for thread-stitching of folded print products each having a spine including at least one fold, the apparatus comprising:

a machine frame;

a sewing station on which print products are stitched along the fold and are then sewn together along the spine to form a book block;

a pivoting saddle having a ridge to supply individual print products positioned straddling the ridge thereon to the sewing station;

a feeder to separate folded print products from a stack of folded print products; and a feeding arrangement including a feed path connecting the feeder to the pivoting saddle, and having a feeding end that cooperates with the feeder to supply the individual print products to the feed path and a discharge end that operates to supply the individual print products to the pivoting saddle, the feeding arrangement adapted to convey the print products either with the fold forward or trailing, wherein the sewing station, as seen from above the machine frame, is arranged on the machine frame of the apparatus, to remain between the feeding end of the feeding arrangement and the ridge of the pivoting saddle.

* * * * *